US007129625B2

(12) United States Patent
Marsh

(10) Patent No.: US 7,129,625 B2
(45) Date of Patent: Oct. 31, 2006

(54) PROTECTED LAMP DEVICE

(75) Inventor: Brent Marsh, San Francisco, CA (US)

(73) Assignee: BJI Energy Solutions LLC, New York, NY (US)

( * ) Notice: Subject to any disclaimer, the term of this patent is extended or adjusted under 35 U.S.C. 154(b) by 182 days.

(21) Appl. No.: 10/658,248

(22) Filed: Sep. 8, 2003

(65) Prior Publication Data

US 2004/0056576 A1 Mar. 25, 2004

Related U.S. Application Data

(63) Continuation-in-part of application No. 09/598,009, filed on Jun. 20, 2000, now Pat. No. 6,616,310, which is a continuation-in-part of application No. 08/630, 361, filed on Apr. 10, 1996, now Pat. No. 6,135,620.

(51) Int. Cl.
*H01J 17/38* (2006.01)
*F21V 15/00* (2006.01)

(52) U.S. Cl. ..... 313/17; 313/1; 313/25; 313/44; 313/50; 313/624; 362/223; 362/224; 362/377

(58) Field of Classification Search ..... 313/17, 313/21, 25, 26, 44, 49, 50, 624, 634, 312, 313/324, 1; 362/223, 224, 368, 369, 373, 362/377, 378

See application file for complete search history.

(56) References Cited

U.S. PATENT DOCUMENTS

| | | | | | |
|---|---|---|---|---|---|
| 3,358,167 | A | * | 12/1967 | Shanks | 313/25 |
| 4,352,539 | A | * | 10/1982 | Vest | 439/236 |
| 4,449,071 | A | * | 5/1984 | Yokoyama | 315/53 |
| 4,990,821 | A | * | 2/1991 | Blaisdell et al. | 313/112 |
| 5,140,216 | A | * | 8/1992 | Darr | 313/25 |
| 5,416,676 | A | * | 5/1995 | Carpenter | 362/158 |
| 5,493,167 | A | * | 2/1996 | Mikol et al. | 313/25 |

* cited by examiner

*Primary Examiner*—Ashok Patel

(57) ABSTRACT

A protected lamp assembly includes a tubular lamp enclosed within a tubular protective housing. The lamp is supported by grommets or bushings of a resilient material that are retained within the housing. An end cap assembly may include the bushing for the lamp and also support the protective housing. Conductors through the end caps communicate with the lamp electrodes. In alternate embodiments the conductors may emerge from one of the end caps or the end caps may include a conductive coating with a connection to the lamp electrodes.

10 Claims, 3 Drawing Sheets

PROTECTED LAMP DEVICE

This is a continuation-in-part of U.S. patent application Ser. No. 09/598,009, filed Jun. 20, 2000, now U.S. Pat. No. 6,616,310, issued Sep. 9, 2003, which is a continuation-in-part of U.S. patent application Ser. No. 08/630,361, filed Apr. 10, 1996, now U.S. Pat. No. 6,135,620, issued Oct. 24, 2000.

FIELD OF THE INVENTION

This invention relates generally to miniature cold cathode fluorescent lamps (CCFLs) and other miniature lamps, associated devices and methods of use, and more specifically, to protected lamp modules which could be used to provide new and unique lighting devices and methods of using them, all of which offer significant savings in cost, operating expense, power consumption and retrofit convenience.

BACKGROUND OF THE INVENTION

Electrically powered exit signs, traffic signals, task lights and other devices are widely used. Fluorescent lamps are used to provide illumination in typical electrical devices for general lighting purposes because they are more efficient than incandescent bulbs in producing light. A fluorescent lamp is a low pressure gas discharge source, in which light is produced predominantly by fluorescent powders activated by ultraviolet energy generated by a mercury plasma forming an arc. The lamp, usually in the form of a tubular bulb with an electrode sealed into each end, contains mercury vapor at low pressure with a small amount of inert gas for starting. The inner walls of the bulb are coated with fluorescent powders commonly called phosphors. When the proper voltage is applied, the plasma forming an arc is produced by current flowing between the electrodes through the mercury vapor. This discharge generates some visible radiation. The ultraviolet in turn excites the phosphors to emit light.

Two electrodes are hermetically sealed into the bulb, one at each end. These electrodes are designed for operating as either "cold" or "hot" cathodes or electrodes, more correctly called glow or arc modes of discharge operation. Electrodes for glow or cold cathode operation may consist of closed-end metal cylinders, generally coated on the inside with an emissive material. Conventional cold cathode lamps operate at a current on the order of a few hundred milliamperes, with a high cathode fall or voltage drop, something in excess of 50 volts. CCFLs are not appreciably affected by starting frequency because of the type of electrode used CCFLs emit light in the same way as to standard hot electrode lamps. The latter type operate as normal glow discharges and their electrodes are uncoated hollow cylinders of nickel or iron. The cathode fall is high and to obtain high efficacy or power for general lighting purposes, conventional lamps are made fairly long, about 2–8 feet, with a diameter of about 25–40 millimeters. About 2000 volts is required for starting these conventional lamps and about 900 to 1000 volts for running.

The advantages of CCFLs, compared with the hot electrode fluorescent lamps are that they have a very long life (usually) 15000 hours or more) in consequence of their rugged electrodes, lack of filament and low current consumption. They start immediately, even under cold ambient conditions. Their life is unaffected by the number of starts. Also, they may be dimmed to very low levels of light output.

U.S. Pat. No. 5,440,467 issued Aug. 8, 1995 to Lautzenheiser teaches a task light. The light assembly is provided for illuminating a work surface below and in front of the light assembly, and includes a housing configured for mounting over the work surface with an elongated linear light source supported in its housing. A tubular lens is built into and part of the housing, and includes prism-shaped triangular rings on its inside surface for controlling the light from the light source onto the work surface therebelow.

Other electric light sources currently include incandescent, compact and tubular fluorescent lamps, plasma arc lamps, neon lamps, electroluminescent (EL) lamps and light emitting diodes (LEDs). The fluorescent, plasma and neon lamps all require a voltage differential which may be achieved with electrodes in the interior of the tube or with conductive coatings or elements on the tube exterior that are adapted to be coupled to a source of electrical energy. High frequency energy fields, such as are generated by tesla coils or the like, can also cause a radiating ionization of the gases without the need for a direct connection to a source of electrical energy.

SUMMARY OF THE INVENTION

The present invention is a protected lamp operating off a main source of electrical power. The lamp has a predetermined length with a first end and a second end. There is a first electrode at the first end and a second electrode at the second end. An essentially transparent outer tubular housing has a first end and a second end with a predetermined length essentially the same as that of the lamp. The tubular housing has a central hollow opening and the lamp is disposed within the tubular housing. The lamp combination also has two end fittings, the end fittings each having a small central opening axially therethrough, the end fittings each comprising a lamp side and a contact side The lamp side is designed to receive a first end or a second end of the lamp within the small central opening. The end fittings each have a radially spaced lip around the small central opening, shaped to receive the first end or the second end of the outer tubular housing for holding the tubular housing radially spaced from the lamp.

In a preferred embodiment the end fittings are made of a resilient material such as rubber. It is also possible to utilize a grommet or o-ring to float the lamp within the tubular outer member. A conductive coating on the exterior surface of the outer tube may be adequate to provide electrical energy to the lamp tube within the outer protective tube using a conductor between the inner and outer members.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE INVENTION

Figure 1:
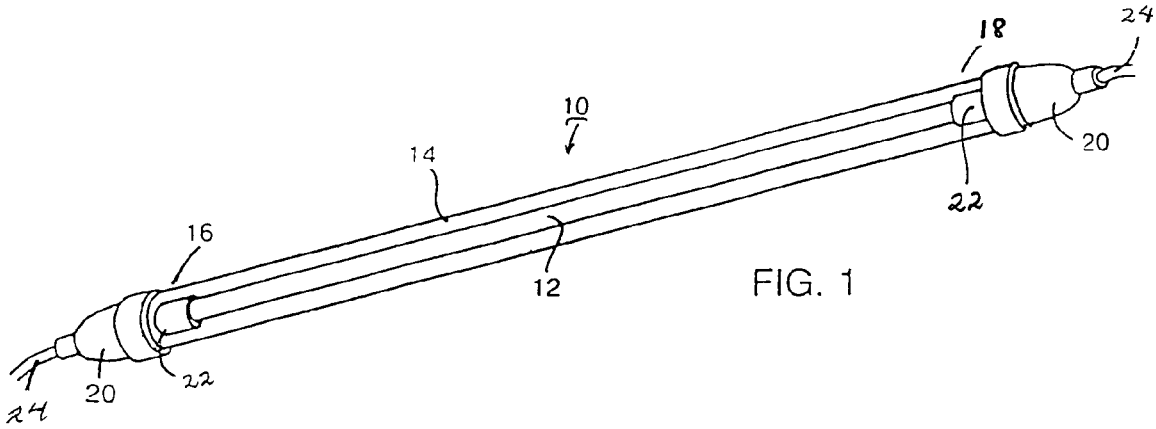
FIG. 1 is a perspective view of a preferred embodiment of the protected lamp assembly of the present invention.

FIG. 1 is a perspective view of a preferred embodiment of a protected lamp assembly 10 of the present invention. In a preferred embodiment, the assembly consists of a CCFL lamp 12, held inside an outer tubular housing 14 at a first end 16 and at a second end 18. The tubular housing 14 is supported and held in place inside end fittings 20. These end fittings can be any type of fitting which will hold a lamp in place, preferably with some degree of support to protect against vibration, etc. In a preferred embodiment, small rubber or plastic grommets or bushings 22 fit inside either end of the outer tubular housing 14 to hold and support the CCFL lamp 12. Contact lead wires 24 can be installed in electrical contact with the electrodes of the lamp through the end fittings 20.

Figure 2:
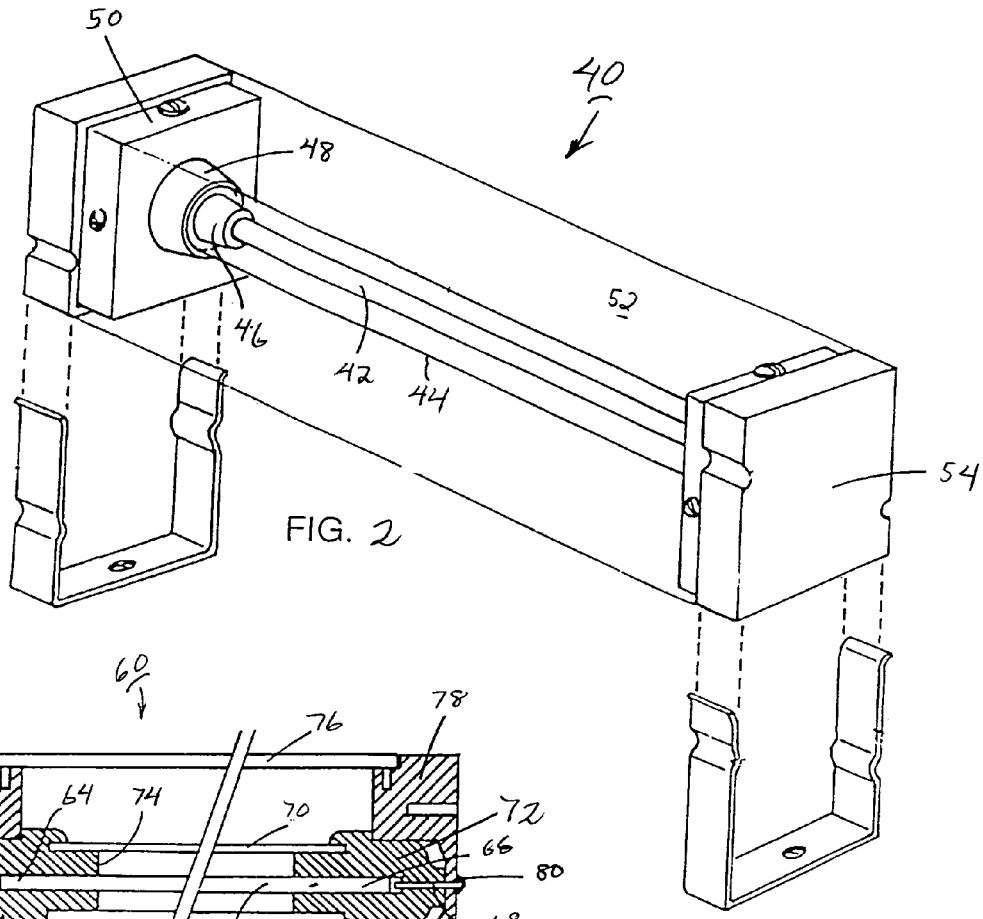
FIG. 2 is a perspective view of an alternative embodiment of a protected lamp assembly according to the present invention.

FIG. 2 is a perspective view of a alternative embodiment of a protected lamp assembly 40 of the present invention. A lamp 42 is disposed within an outer tubular housing 44. A resilient collar 46 supports the lamp 42 and may be part of larger structure 48 which supports the outer tubular housing 44, as well.

End wall assemblies 50 serve to support and maintain the lamp assembly 40 integrity and will be present on either end of the elongated unit. Either opaque, essentially transparent, or colored transparent protective panels 52 can be placed on one or more sides of the essentially cubic rectangular or tubular assembly which is held together by attachment to the end wall assemblies 50.

These panels 52 could also be coated with a reflective coating, film or other material. They might also serve as diffuser panels to soften or otherwise alter the nature of the radiating light. It will be understood that the outer tubular housing 44 will be present in the case of a particularly fragile lamp structure, but may not be necessary in an embodiment in which the protective panels 52 afford substantially the same protection.

Electrical contacts at either end 54 of the light assembly 40 will serve as inputs to power the light assembly 40. It will be understood that while the end wall assembly might have a plastic construction, an electrical contact will be provided. This may be a layer of conductive material or some other electrical contact means which could be placed on the larger structure 48 that supports both the lamp 42 and the outer tubing 44.

Figure 3:
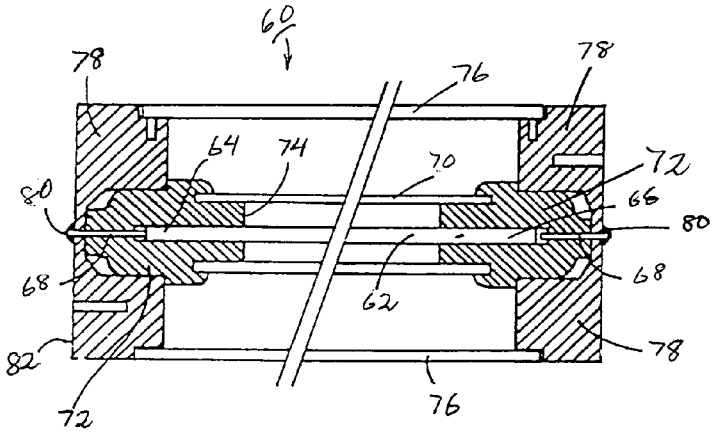
FIG. 3 is a cross section side view of a the protected lamp assembly similar to that of FIG. 2.

FIG. 3 is a cross section of an alternative protected light assembly 60 with the protective housing of the present invention. In cross section, a lamp 62 terminates at both a first end 64 and a second end 66 in electrodes 68. An outer tubular housing 70 is held in place with the lamp 62 by end fitting 72 which incorporate the bushings 74 that support the lamp 62. One or more transparent, opaque, semi-transparent or colored protective panels 76 are held in place by attachment to end wall assemblies 78. Electrical leads 80, and, in preferred embodiments, electrical contact surfaces 82, are configured to connect the electrode 68 on the lamp 62 with the power source wires (not shown). These contacts could be copper pieces or could be conductive films or the like. In a preferred embodiment, electrical leads and contacts may be made integral with the end walls.

The protected lamp assembly (or lamp module) of the present invention is a novel and remarkable device. As an integrated unit, the assembly can be manufactured in a variety of different standard sizes and shapes. They can be round, hemispherical, square or other shape in cross section. These protected lamp assemblies will be lightweight, weather and water proof, durable and economical. They form a sealed chamber which contains the light source and which is sealed from the exterior or ambient atmosphere in which the light operates. As the standard becomes more widely used, consumers will find it very convenient and economical, as well as inherently energy saving, to replace the entire integrated light assembly whenever an individual lamp fails.

Figure 4:
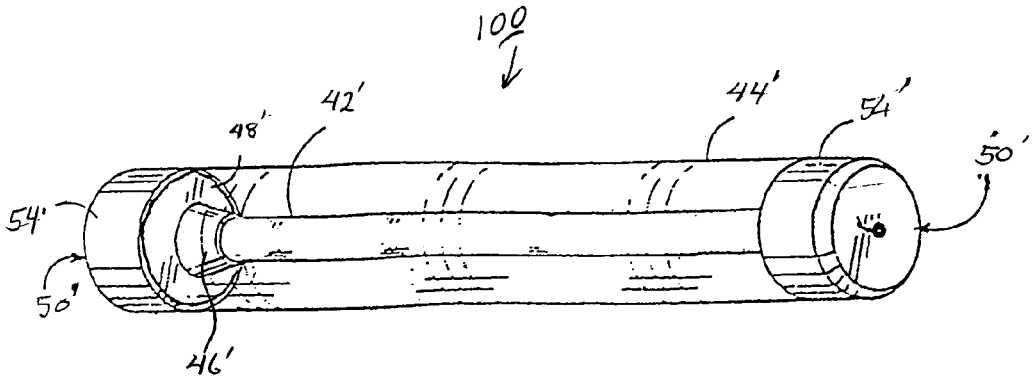
FIG. 4 is a perspective view of another alternative embodiment of a protected lamp assembly according to the present invention.

FIG. 4 shows a general lighting unit 100 incorporating the improvements of the present invention. As shown, the lamp elements of FIGS. 2 and 3 have been modified to change the end of the light assembly from square to round. Accordingly, the same reference numbers have been used for similar elements but with primes added to the modified elements.

Figure 5:
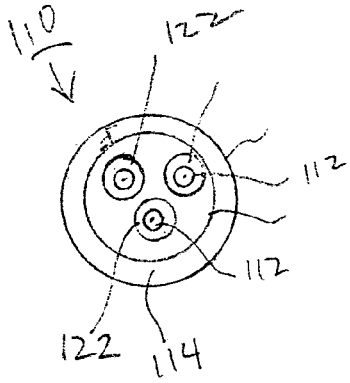
FIG. 5 is a section view of a protected lamp assembly in which three lamps are contained within a protective housing.

FIG. 5 is a sectional view of yet another alternative embodiment of the protected lamp assembly of the present invention. As shown in FIG. 5, more than one lamp element 112 can be placed inside a single protective housing element 114. Each of the lamp elements 112 is supported by a grommet or o-ring 122 which permits a contact 124 to the respective electrodes (not shown). All are secured to the protective housing 114 by an integral end plug 126 which accommodates the contacts 124 to extend beyond the assembly 110.

Figure 6:
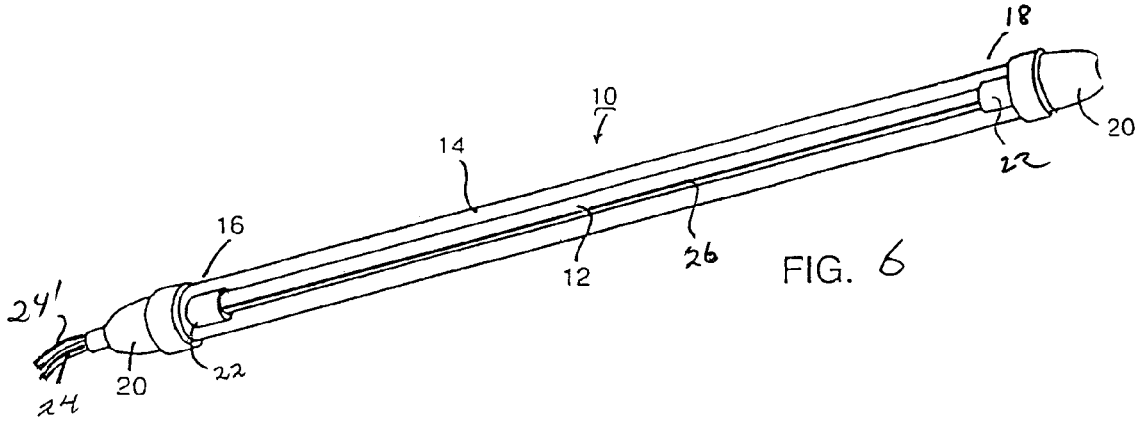
FIG. 6 is a perspective view of an alternative embodiment of a protected lamp in which the electrical conductors are at one end of the lamp.

Turning next to FIG. 6, there is shown an alternative embodiment of the protected lamp of FIG. 1. In the embodiment of FIG. 6, the protected lamp 10' is substantially identical to the lamp of FIG. 1 and, accordingly, similar reference numerals have been used, with the different elements distinguished by the use of a prime. The protected lamp unit 10' includes all of the elements of the lamp 10 of FIG. 1, except that both conductors, 24, 24' emerge from one of the end caps 20. The energizing electrode (not shown) of the lamp element 12 is connected to a conductor 26 which passes through the grommets 22 to extend the length of the lamp element and emerge from the end cap 20, here shown to be the end cap 20 at the left end of the protected lamp 10'.

Thus, there has been shown and described, a protected lamp element especially useful for cold cathode fluorescent lamps (CCFLs) but equally useful for any tubular lamp which is to be used in a hostile environment where the relative fragility of the lamp would be a disincentive for its use. The protected lamp element could be an "off the shelf" module suitable for use in a variety of applications. Embodiments include applications with wired contacts to lamp electrodes or conductively coated enclosure ends which can supply electrical energy to the lamp.

Further, while the illustrated embodiments show the protected lamp element with electrical contacts at opposite ends of the structure, it is within the scope of the invention to have a conductor coupling the lamp electrode at one end to the opposite end of the structure so that both electrodes can be energized from the same end. Accordingly, the scope of the invention should only be limited by the claims appended hereto.

The invention claimed is:

1. A protected cold cathode fluorescent (CCFL) lamp assembly comprising:

a. a tubular CCFL lamp element having two ends, and at each end at least one energizing electrode adapted to be coupled to a source of electrical energy;

b. a protective housing element surrounding said lamp element and substantially coextensive therewith;

c. resilient lamp support members for holding the respective ends of said lamp element within said protective housing element spaced apart from the interior surfaces thereof, the resilient support members adapted to provide circumferential support to at least portions of the respective electrodes, such that the electrodes are supported against bending; and d. conductive means for coupling said electrodes to a source of energy exterior to said protective housing element.

2. The protected lamp assembly of claim 1, above, further including end cap means mounted at the ends of said protective housing element.

3. The protected lamp assembly of claim 2, above, wherein said lamp support members are integral with said end cap means.

4. The protected lamp assembly of claim 1, above, wherein said conductive means include a conductive coating in electrical contact with said electrodes.

5. A protected cold cathode fluorescent (CCFL) lamp assembly, comprising:

a. at least one tubular CCFL lamp element having two ends, and at each end at least one energizing electrode adapted to be coupled to a source of electrical energy;

b. a protective housing element surrounding said at least one CCFL lamp element and substantially coextensive therewith;

c. at least one resilient lamp support member for holding at least one end of the at least one lamp element within said protective housing element spaced apart from the interior surfaces thereof; and d. conductive means for coupling said electrodes to a source of energy exterior to said protective housing element; and e. end cap means mounted at one end of said protective housing element, the end cap means adapted to support the housing element and to support the conductive means;

wherein the conductive means includes a conductor extending from one of the energizing electrodes to and through the end cap at the opposite end of said lamp element.

6. A protected cold cathode fluorescent (CCFL) lamp assembly comprising:

a. a tubular CCFL lamp element having two ends, and at each end at least one energizing electrode adapted to be coupled to a source of electrical energy;

b. a. protective housing element surrounding said lamp clement and substantially coextensive therewith;

c. resilient lamp support members for holding the respective ends of said lamp element within said protective housing element spaced apart from the interior surfaces thereof, the resilient support members adapted to provide circumferential support to at least portions of the respective electrode, such that the electrodes are supported against bending;

d. end cap means mounted at the ends of said protective housing element; and e. conductive means for coupling said electrodes to a source of energy exterior to said protective housing element.

7. The protected lamp assembly of claim 6, above, wherein said lamp support members are integral with said end cap means.

8. The protected lamp assembly of claim 7, above, wherein said conductive means include elements extending out of said end cap means which are adapted to connect to a source of energy.

9. The protected lamp assembly of claim 7, above, wherein said conductive means further include a conductor connected to one of the energizing electrodes at one end of said tubular lamp element, said conductor extending to the opposite end of said tubular lamp element and through said end cap means whereby a source of energy need only be applied to one end of the protected lamp assembly.

10. The protected lamp assembly of claim 6, above, wherein said conductive means include a conductive coating in electrical contact with said electrodes.

* * * * *